US007544095B2

(12) United States Patent
Droesbeke et al.

(10) Patent No.: US 7,544,095 B2
(45) Date of Patent: Jun. 9, 2009

(54) CABLE CONNECTOR

(75) Inventors: Gert Droesbeke, Geel (BE); Ron Christian Weber, Ap Oisterwijk (NL); Nico Van Stiphout, Beek en Donk (NL); Leonard Van Kuijk, Oosterhout (NL); Ben Hubertus Libregts, Vlijmen (NL); Per Georg Gabrielsson, Hässelby (SE)

(73) Assignee: FCI, Versailles (FR)

( * ) Notice: Subject to any disclaimer, the term of this patent is extended or adjusted under 35 U.S.C. 154(b) by 0 days.

(21) Appl. No.: 11/660,010

(22) PCT Filed: Jul. 11, 2005

(86) PCT No.: PCT/EP2005/007487

§ 371 (c)(1),
(2), (4) Date: Oct. 9, 2007

(87) PCT Pub. No.: WO2006/018076

PCT Pub. Date: Feb. 23, 2006

(65) Prior Publication Data

US 2008/0124975 A1 May 29, 2008

(30) Foreign Application Priority Data

Aug. 18, 2004 (NL) ..... 1026863

(51) Int. Cl.
*H01R 13/648* (2006.01)

(52) U.S. Cl. ..... 439/607; 439/906

(58) Field of Classification Search ..... 439/607, 439/610, 901, 904, 906
See application file for complete search history.

(56) References Cited

U.S. PATENT DOCUMENTS

| | | | | |
|---|---|---|---|---|
| 6,168,466 | B1 | 1/2001 | Chiou | 439/607 |
| 6,386,918 | B1 * | 5/2002 | Zheng et al. | 439/607 |
| 2001/0046809 | A1 | 11/2001 | Chiran et al. | 439/607 |

FOREIGN PATENT DOCUMENTS

| | | | |
|---|---|---|---|
| DE | 199 41 806 | A1 | 3/2000 |
| WO | WO 2004/057707 | A1 | 7/2004 |

* cited by examiner

*Primary Examiner*—Khiem Nguyen
(74) *Attorney, Agent, or Firm*—Harrington & Smith, PC

(57) ABSTRACT

The invention relates to a cable connector with a housing including a base extending along a longitudinal axis of the cable connector. The base includes a cable entry portion for accommodating a ferrule system of a cable and a further portion extending from said cable entry portion along said longitudinal axis. The further portion includes one or more mounting structures. The base also includes a housing part with one or more mounting elements adapted to cooperate with said mounting structures to mount the housing part to the base to complete said housing at said further portion. The mounting structures and mounting elements are structured such that said housing part is forced towards said base when said housing part is moved along said longitudinal axis from a mounting position to a mounted position. Accordingly a tight fitting and easily assembled cable connector is obtained.

19 Claims, 9 Drawing Sheets

CABLE CONNECTOR

The invention relates to a cable connector with a housing comprising:

a base extending along a longitudinal axis between a front side and a rear side of said cable connector, said base comprising a cable entry portion for a cable at said rear side and a further portion extending from said cable entry portion along said longitudinal axis to said front side, wherein said further portion comprises one or more mounting structures;

at least one housing part with one or more mounting elements adapted to cooperate with said mounting structures to mount said housing part to said base to complete said housing at said further portion.

WO2004/057707 discloses a cable connector comprising a housing having a diecast base substantially extending between a front side and a rear side of the connector. A diecast first housing part is mounted to the diecast base such that said diecast first housing part and a first portion of said diecast base determine a first cable connector portion at the rear side. A metal sheet formed second housing part is mounted to the diecast base such that the metal sheet formed second housing part and a second portion of said diecast base determine a second cable connector portion at said front side. Such a cable connector combines a diecast base with a metal sheet formed housing part at the front side. The metal sheet formed housing part provides the possibility to limit the front side wall thickness of the cable connector housing, such that the front side of this cable connector can be inserted in a connecting panel with openings of smaller dimensions, while still using diecast parts. Diecast parts generally allow large freedom with respect to shapability of such a part. The die-case base which extends between the front side and the back side of the entire housing provides rigidity to this cable connector.

A problem associated with the prior art cable connector is that mounting of the metal sheet formed part to the diecast base is complex and occasionally results in inadequate mounting which is detrimental for the mechanical and electromagnetic shielding performance of the cable connector.

It is an object of the invention to provide a cable connector with a base extending along a longitudinal axis of the cable connector, with improved mounting means for mounting a housing part to such a base.

This object is achieved by providing a cable connector characterized in that said mounting structures and said mounting elements are structured such that said housing part is forced towards said base when said housing part is moved along said longitudinal axis from a mounting position to a mounted position. By moving the housing part along the longitudinal axis of the base, the housing part is tightened to the base by the respective configurations of the cooperating mounting elements and mounting structures. Accordingly, the mounting elements and mounting structures can be preformed, avoiding the need for an operator to manually form or modify the mounting means for each individual connector. Further, the preformed mounting elements and mounting structures are accurately shaped to ensure adequate tightening of the housing part to the base. Moreover, manufacturing costs are reduced and/or throughput is higher since the tolerance holding capabilities are built into the supplied connector components ensuring appropriate performance and quality of the resulting cable connector.

In an embodiment of the invention, the housing part comprises a top wall and side walls, said sidewalls comprising said mounting elements, wherein said mounting structures and said mounting elements are structured such that said side walls are forced towards said longitudinal axis and said top wall is forced towards said base when said housing part is moved from said mounting position to said mounted position. Accordingly, the housing part is tightened to the base in two directions. For the side walls of the housing part, this is preferably achieved by an embodiment wherein said base comprises edges parallel to said longitudinal axis and said mounting structures are provided at said edges, each of said mounting structures comprising a guiding slot for said mounting element and a wedge-shaped structure adapted to cooperate with said mounting element to force said housing part towards said base. By sliding the mounting elements through said guiding slot and along said wedge-shaped structure, the mounting elements attached to the side walls of the housing part are forced by a surface of the structure such that the side walls are tightened to the base.

In the case of a diecast base and a sheet metal housing part, the diecast base may be damaged by cutting interaction of the mounting elements and the diecast mounting structure. The resulting loose particles may influence the performance of the connector, e.g. by providing electrical shortcuts at undesired locations. Therefore, in a preferred embodiment of the invention, the wedge-shaped structure comprises a first surface with a normal that makes a first angle with respect to said longitudinal axis and said mounting element comprises a hook-shaped section with an inner surface arranged to abut said first surface of said wedge-shaped structure on mounting, wherein the normal of said inner surface makes a second angle with respect to said longitudinal axis and wherein said second angle is smaller than said first angle. Consequently, the inner surface of the hook-shaped portion first contacts the wedge-shaped structure along a line when moving the housing part from the mounting position to the mounted position, and subsequently a planar contact is established. Thus, a severe cutting effect from the mounting element to the mounting structure is prevented.

In an embodiment of the invention, the normal of a guiding surface of said guiding slot and/or the normal of a second surface of said wedge-shaped structure build an angle with a direction normal to said base such that a top wall of said housing part is forced towards said base when moving said housing part along said longitudinal axis from said mounting position to said mounted position. Accordingly, the housing part is further tightened to the base.

As density considerations require the wall thickness of the base of the cable connector to be small, the mounting structure is preferably formed in a bulge protruding inside the connector housing.

In an embodiment of the invention, the mounting structures comprise an insertion structure adapted to insert said mounting elements substantially perpendicularly to said longitudinal axis in said mounting position. Accordingly, the housing part does not have to be deformed or otherwise manipulated for the mounting elements to enter the corresponding mounting structures in the base.

In an embodiment of the invention, the housing part comprises counterforce structures near said mounting elements adapted to interact with said base opposite to said force towards said base when said housing part is moved from said mounting position to said mounted position. These counterforce structures reduce the probability that the preformed mounting structures will be damaged during mounting, as may otherwise be the case for relatively soft materials such as diecast metal.

In an embodiment of the invention, the base comprises one or more support structures adapted to support contact edges of said housing part such that contact edges of said housing part are in planar contact with said base when said housing part is moved from said mounting position to said mounted position. Again, this configuration prevents a cutting edge contact between the housing part and the base.

In an embodiment of the invention, the cable entry portion comprises a locking structure adapted to cooperate with locking elements of said housing part when said housing part is in said mounted position. Such a locking arrangement contributes to the ease of installation of the cable connector. The mounting elements deform elastically during movement of the housing part to the mounted position. In the mounted position, therefore, the housing part tends to return to the mounting position by the spring force action of the mounting elements. The locking arrangement allows the operator to lock the housing part in the mounted position and enables him to test or further complete the cable connector. In one embodiment, the locking element comprises a latch and said locking structure comprises a surface adapted to cooperate with said latch to lock said housing part in said mounted position. This latched arrangement guarantees safe locking of the housing part. In another embodiment, the locking element comprises a convex or a concave element and said locking structure comprises a complementary concave respectively convex structure to lock said housing part in said mounted position. Such structures are easily manufactured and do not require the operator to manipulate a latch when reopening the housing. Accordingly, reparability of the cable connector is improved.

In a preferred embodiment of the invention, the further portion comprises one or more terminal block housings, each having at least one positioning profile and said housing part comprises a front edge with one or more positioning elements adapted to cooperate with said positioning profile such that the position of said terminal block housings in the direction normal to said base is determined by said housing part in said mounted position. As the terminal block housings are typically piled up to a stack at the front side of the cable connector, cumulative tolerance stacks are obtained. The cooperation of the individual positioning profiles with the accurately defined positioning elements at the front side of the housing part, provides for an improved positioning of the terminal block housings in the cable connector.

In an embodiment of the invention, the cable connector comprises a further housing part adapted to cooperate with said base to complete said housing at said cable entry portion, wherein said further housing part comprises structures to interact with said housing part to force said housing part towards said base and/or to block said housing part from moving towards said mounting position. The further housing part completes the housing of the cable connector and provides additional features to position the housing part at the front side of the cable connector.

In a preferred embodiment of the invention, the cable connector base is a diecast metal base and said housing part is a sheet metal housing part. The further housing part preferably also is a diecast metal component. Such a cable connector combines a die-cast base with a metal sheet formed housing part at the front side. The metal sheet formed housing part provides the possibility to limit the front side wall thickness of the cable connector housing, such that the front side of this cable connector can be inserted in a connecting panel with openings of smaller dimensions, while still using die-cast parts. Diecast parts generally allow a large freedom with respect to shapability of such a part. The diecast base which extends between the front side and the back side of the entire housing provides rigidity to this cable connector. However, especially if these requirements are of less relevance, other materials for the various components of the housing of the cable connector are envisaged as well.

It is noted that the above described embodiments, or aspects thereof, can be combined.

The invention will be further illustrated with reference to the attached drawings, which schematically show preferred embodiments according to the invention. It will be understood that the invention is not in any way restricted to these specific and preferred embodiments.

Figure 1:
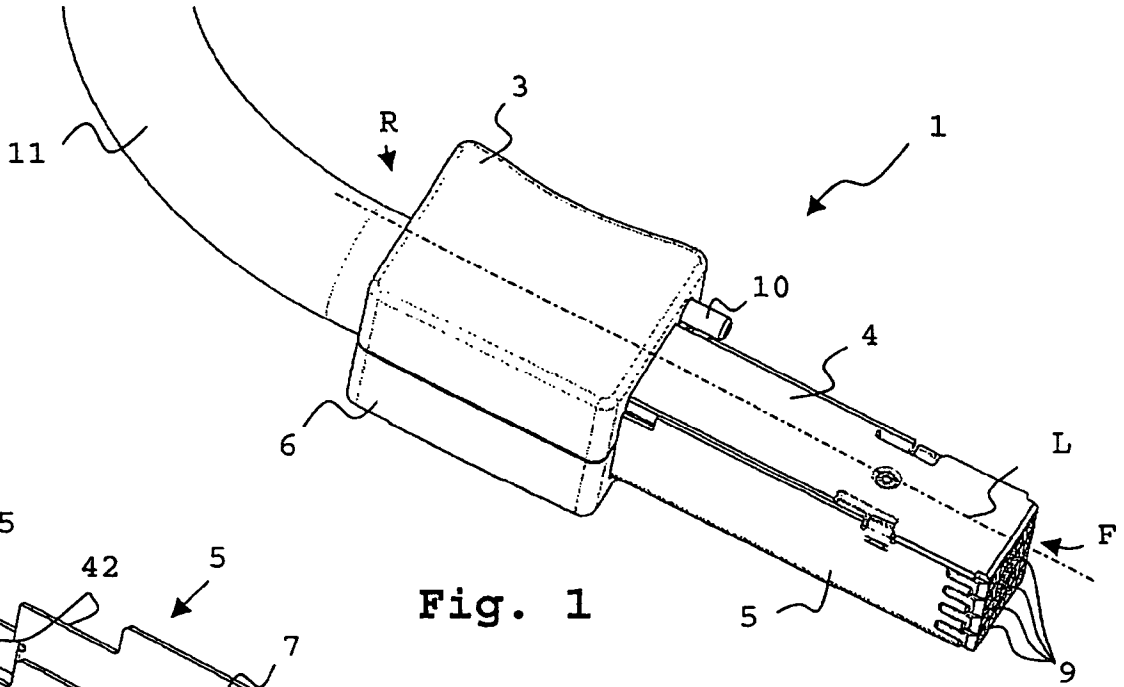
FIG. 1 shows a cable connector according to an embodiment of the invention.

FIGS. 1, 2 and 3A-3F show an I/O cable connector 1 and its modular components viz. a base 2 comprising a cable entry portion 3 and a further portion 4, a housing part 5 and a further housing part 6. The base 2 is a diecast metal component, whereas the housing part 5 is a sheet metal U-shaped component with side walls 7 and a top wall 8.

The cable connector 1 has a front side F comprising terminal block housings 9 for connecting the cable connector 1 to a counter part. These terminal block housings 9 and their contacts were described in WO 2004/057707 of the applicant for the present invention, which is incorporated herewith by reference with respect to shape, construction and function of the terminal block housings. After mating, a screw 10 can be employed to attach the cable connector 1 to e.g. a backpanel or board connector housing. The further portion 4 of the base 2 extends from the cable entry portion 3 along a longitudinal axis L to the front side F of the cable connector. Further, the cable connector 1 has a rear side R with a cable entry for a cable 11.

Figure 4A:
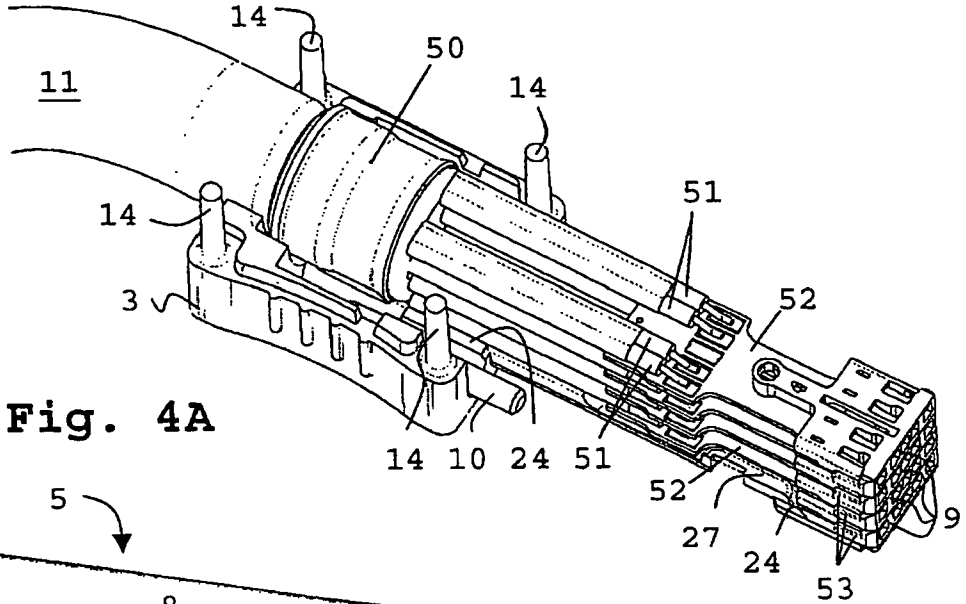
FIGS. 4A and 4B show a cable provided in a cable connector of FIG. 1 according to an embodiment of the invention.
Figure 4B:
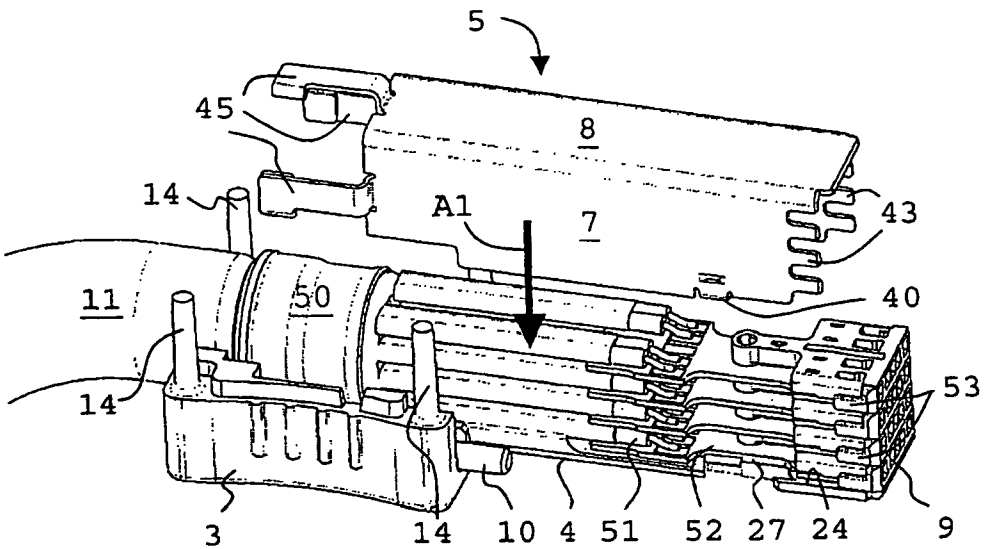
Figure 9A:
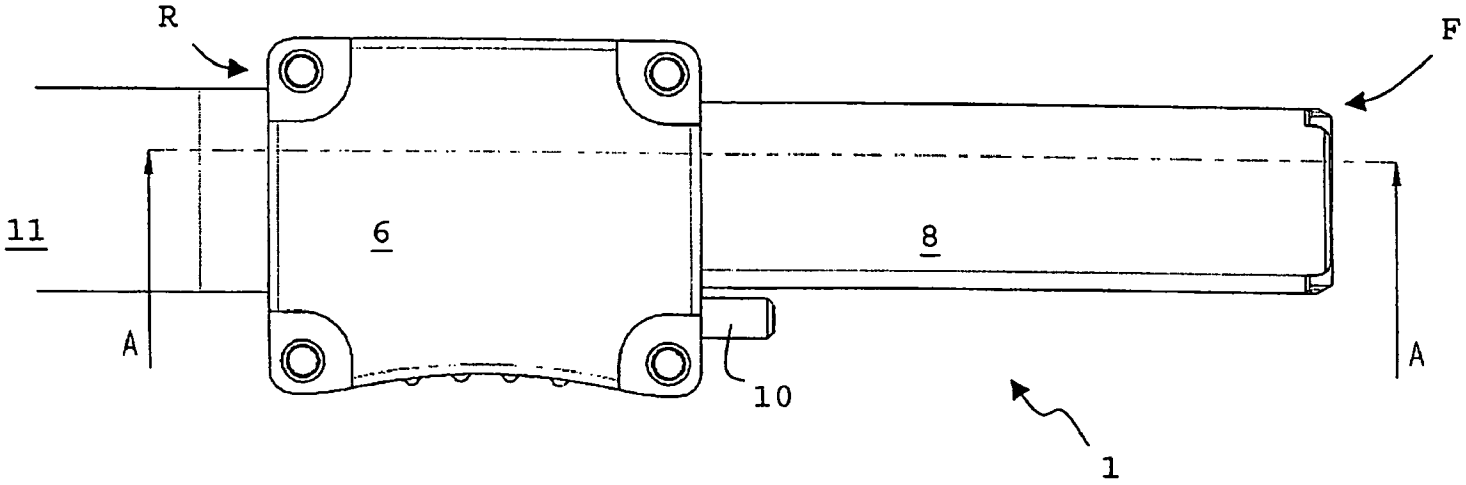
FIGS. 9A and 9B show a completed cable connector and a cross-section view along A-A.
Figure 9B:
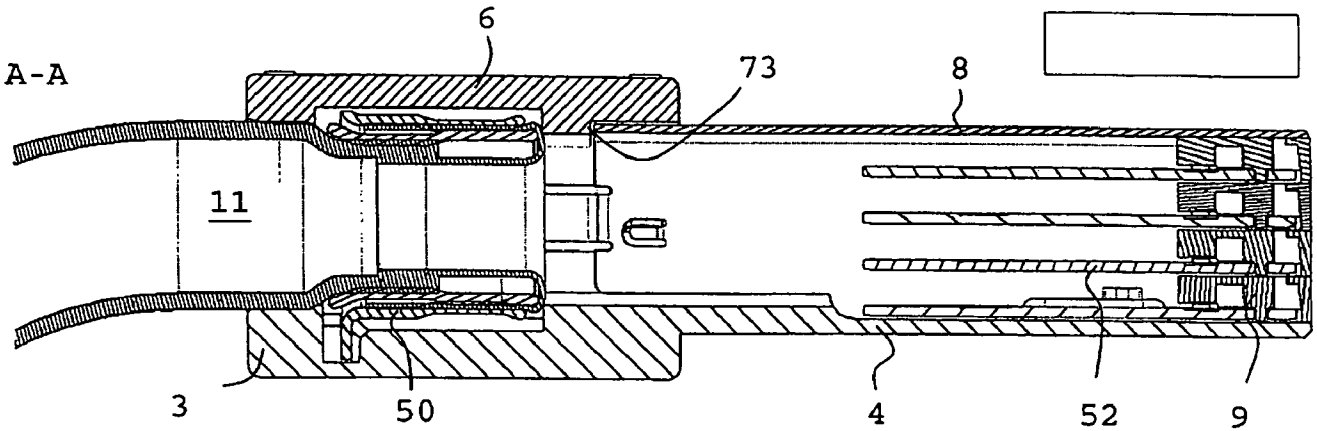

The cable entry portion 3 comprises a space to accommodate a ferrule system of the cable 11 (see FIGS. 4A, 4B and 9B). Hereinafter, the cable entry portion 3 will therefore also be referred to as ferrule portion 3. The space comprises ribs 12 to cooperate with the ferrule system and a recessed portion or slot 13 to accommodate a flange portion (shown in FIG. 9B) of the ferrule system of the cable 11. These features of the ferrule portion 3 of the cable connector are described in the non-prepublished Dutch patent application NL 1026451 of the applicant of the present application, that is herewith incorporated by reference for an embodiment of the ferrule portion 3.

Further, the ferrule portion 3 comprises mounting pillars 14 for mounting the further housing part 6 to the ferrule portion 3 to complete the housing of the cable connector 1 at the ferrule portion 3. Moreover, the ferrule portion 3 comprises a structure 15 to receive the screw 10.

As an aspect of the invention, the ferrule portion 3 of the cable connector 1 is provided with a locking structure 16 with a surface 17 to cooperate with the housing part 5, as will be explained in further detail with reference to FIG. 7A.

The further portion 4, extending from the ferrule portion 3 of the base 2, comprises a surface with a thickened portion 20 near the ferrule portion 3 and a thinner portion 21 at the front side F of the cable connector 1. The thinner portion 21 has recesses 22 for avoiding electrical short circuits if the terminal block housings 9 are applied and the wires of the cable 11 are terminated at connection boards attached to these terminal block housings 9 (see FIG. 4A). Further an opening 23 is provided to receive a peg for initial positioning of the terminal block housings 9 in the direction of the normal N2 of the surface of the thinner portion 21.

The cable connector 1 has support structures 24 near the ferrule portion 3 and at the front side F to support the housing part 5.

The base 2 of the cable connector 1 has mounting structures 25 near the front side F of the cable connector 1 at edges 26. As for high density cable connectors, the wall thickness of the housing should be minimal, the mounting structures 25 are designed as bulges 27 protruding from the surface 21 inside the interior of the housing of the cable connector 1. The mounting structures comprise an insertion structure 28, manufactured as a slot in the bulge 27.

The mounting structures 25 each comprise a guiding slot 29 and a wedge-shaped structure 30 designed within the bulge 27. The wedge-shaped structure 30 has a first surface 31 with a normal N31 making a first angle $\alpha$ with the longitudinal axis L such that the guiding slot 29 is narrowed in the direction from the rear side R to the front side F of the cable connector along the longitudinal axis L. This is best illustrated by the planar projection of the front part of the further portion 4 in FIG. 3E. Further, the normal N32 of a second surface 32 of the wedge-shaped structure 30 builds an angle $\beta$ with the direction N2 normal to the base 2 as best illustrated by the side projection of the front part in FIG. 3F.

The U-shaped housing part 5 comprises mounting elements 40 to cooperate with the mounting structures 25 of the base 2. The mounting elements 40 are hook-shaped elements extending from the side walls 7. These mounting elements 25 can be provided by stamping eventually followed by bending appropriate parts of the housing part 5. Further, the sidewalls 7 comprise optional counterforce structures 41 positioned to interact with the outer surfaces of the bulges 27 during mounting of the housing part 5 to the base 2. The sidewalls 7 also have contact edges 42 positioned to interact with the support structures 24.

The front edge of the housing part 5 comprises positioning elements 43 that determine the final position of the terminal block housings 9 after having been pre-positioned by the above-mentioned peg inserted in the opening 23. As the housing part 5 is preferably made of sheet metal, stamping of the sheet metal may provide the accurately defined positioning elements 43.

At the other side of the housing part, the sidewall 7 comprises a locking element 44, here displayed as a latch 44. The latch 44 is positioned such that it coincides with the locking structure 16 for a certain position of the housing part 5, such that the cooperation of the latch 44 with the surface 17 locks the housing part in this position, as illustrated in FIG. 7A.

Finally, the housing part 5 comprises mounting beams 45 extending from the rear edge of the housing part 5. When the housing part 5 is mounted on the base 2, the mounting beams 45 extend towards the ferrule portion 3. As the inner side of the housing part 5 is preferably covered by an electrically insulating layer to avoid electrical short circuiting between the system ground and ground contacts at the terminal blocks, the mounting beams 45 have folded end portions 46 to electrically connect the ferrule system of the cable 11 and the housing part 5.

FIGS. 4A and 4B, 5A-5C and 6A-6C illustrate subsequent steps of the mounting process of the housing part 5 to the base 2.

In FIG. 4A, the cable 11 provided with a ferrule system 50 is applied to the base 2. The ferrule system 50 is positioned in the ferrule portion 3 of the base 2 by inserting a flange (shown in FIG. 9B) in the recessed portion 13. Individual wires 51 of the cable 11 are terminated at connection boards 52 associated with the terminal block housings 9 at the front side F of the cable connector 1. The connection boards or printed circuit boards (PCB's) 52 have curved edges to enable them to pass the bulges 27 accommodating the mounting structures 25. The terminal block housings 9 are here initially positioned in the direction normal to the base 2 on top of each other. The terminal block housings 9 each comprise positioning profiles 53, either as an integral part of the terminal block housings 9 or as separate parts attached to said terminal block housings 9.

FIG. 4B shows the situation wherein the housing part 5 is positioned above the base 2 of the cable connector 1 in order to position the housing part 5 in the mounting position. Accordingly, the mounting elements 40 should be positioned such that these mounting elements 40 can enter the insertion structure 28 of the mounting structure 25 substantially perpendicular to the longitudinal axis L of the cable connector 1, i.e. here in the direction of the normal N32 indicated by the arrow Al. The insertion structure 28 is formed such that the sidewalls 7 of the housing part 5 are substantially elastically deformed when bringing the housing part 5 into the mounting position.

Figure 5B:
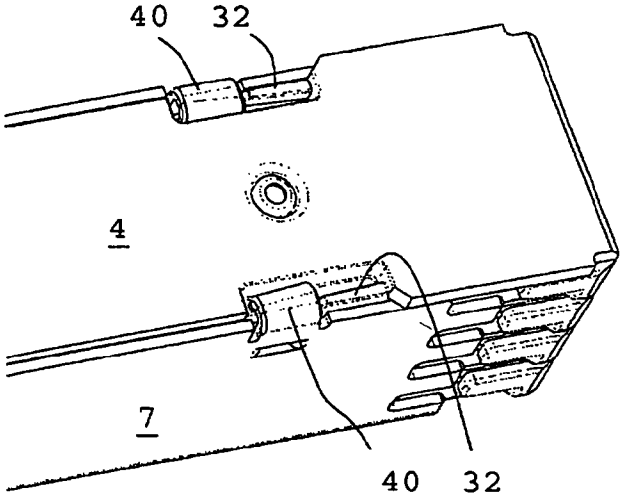
FIGS. 5A-5C show various images of details of the cable connector of FIG. 1 with the housing part in the mounting position according to an embodiment of the invention.
Figure 5A:
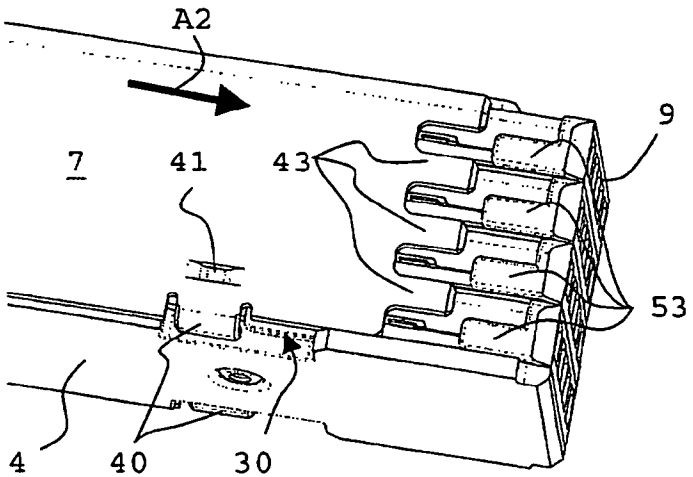
Figure 5C:
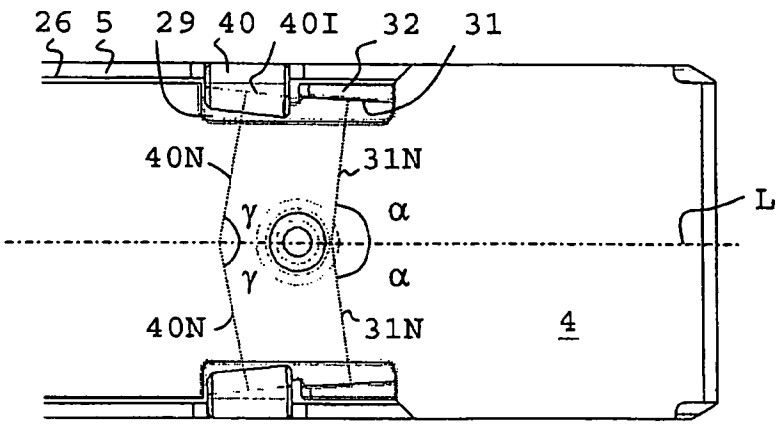

FIGS. 5A and 5B shows the front part of the cable connector 1 in different perspectives with the housing part 5 in the mounting position. FIG. 5C depicts a planar projection of the of the further portion 4 of FIG. 5B. In the mounting position, the mounting elements have been inserted in the mounting structure 25 via the insertion structure 28. The end portion of the hook shaped mounting element 25 may abut surface of the guiding slot 29.

For mounting the housing part 5, the housing part 5 should be moved along the longitudinal axis L in the direction, indicated by the arrow A2, from the rear side R to the front side F of the cable connector 1. As the diecast metal base 2 is a relatively soft material and loose metal particles can be detrimental for the performance of the cable connector 1, care should be taken that the housing part 5 does not damage the base 2. Therefore, the inner surface 40I of the mounting element 40 is not parallel to the surface 31 of the wedge-shaped structure 30 as this might cause the mounting element 40 to have a cutting edge contact with this surface 31 when moved in the direction of the arrow A2. More particularly, the normal 40N of the inner surface 40I builds and angle $\gamma$ with the longitudinal axis L that is smaller than the angle $\alpha$ defined previously, such that on abutment of the mounting element 40 with the wedge-shaped structure 30 first a line contact is made which smoothly develops into a planar contact of the surfaces 31 and 40I.

For the same reason, in the mounting position, the support structures 24 support the contact edges 42 such that the housing part 5 is in substantially planar contact with the base 2 when in the mounting position.

Figure 6B:
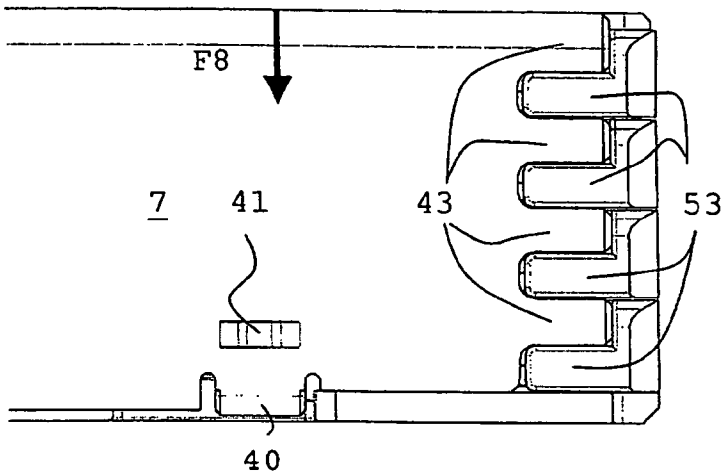
FIGS. 6A-6C show various images and details of the cable connector of FIG. 1 with the housing part in the mounted position according to an embodiment of the invention.
Figure 6A:
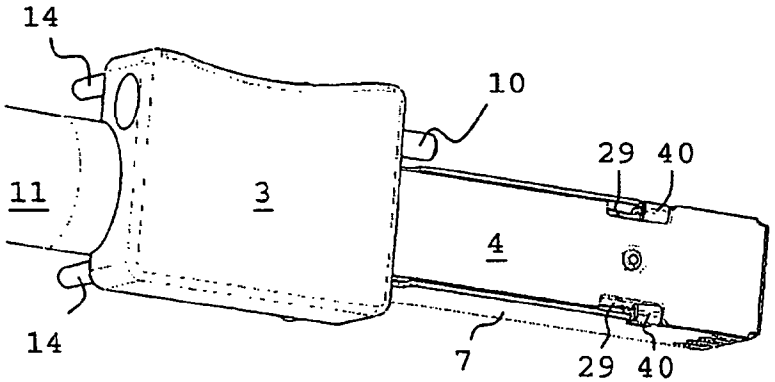
Figure 6C:
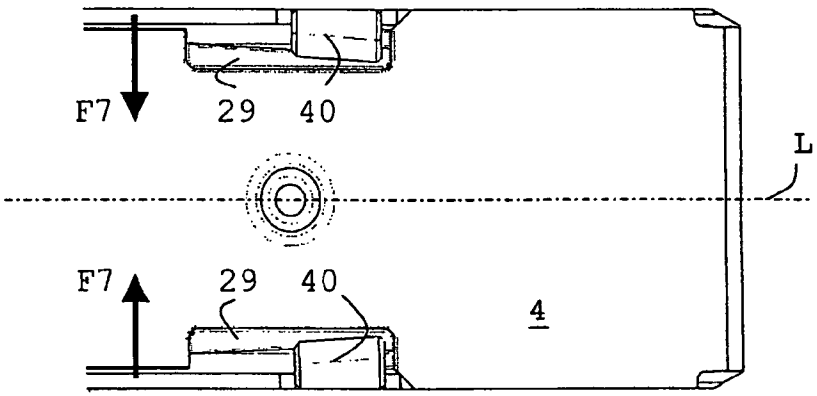

FIGS. 6A shows the cable connector 1 wherein the housing part 5 is moved in the direction A2 to the mounted position. During this operation several processes take place, while the housing part 5 remains substantially parallel to the base 2.

As shown in FIG. 6B, the positioning elements 43 at the front edge of the housing part 5 interact with the positioning profiles 53 provided on the terminal block housings 9. This interaction makes that the initial positioning of the terminal block housings 9 is corrected by the more accurately defined positioning elements 43, since the positioning elements are designed in a stamping process which is highly accurate in it-self. Accordingly, a highly precisely positioned terminal block housing arrangement is obtained at the front side F of the cable connector 1.

Even more importantly is the interaction of the mounting structure 25 with the mounting elements 40. When the housing part 5 is moved in the direction of the longitudinal axis L, the hook-shaped portion of the mounting element 40 contacts the wedge-shaped structure 30, more particularly, the first surface 31 and the second surface 32. As described above, the inner surface 40I develops a planar contact with the surface 31 during the forward motion of the housing part 5. Meanwhile, the slope of the surface 31 makes that the motion of the mounting element 25 through the guiding slot 29 forces both sidewalls 7 of the housing 5 towards the longitudinal axis L, as indicated by arrows F7 in FIG. 6C. Further, the slope of the surface 32 results in the top wall 8 of the housing part being forced towards the base 2 when the hook-shaped mounting element 40 progresses through the guiding slot 29, as indicated by the arrow F8.

The guiding slot 29 narrows in the direction from the mounting to the mounted position of the housing part 5, such that at a certain instance, further movement of the housing part 5 is prevented since further progression of the mounting element 40 in the guiding slot 29 is stopped. However, preferably, the movement of the housing part 5 is terminated before this stage and is determined by the interaction of the positioning elements 43 on the front edge of the housing part 5 and the positioning profiles 53 of the peg-fixated terminal block housings 9.

In conclusion, in this embodiment, the mounting structure 25 and the mounting elements 40 are structured such that the housing part 5 is forced towards the base 2 when the housing part 5 is moved along the longitudinal axis L from a mounting position to a mounted position. By moving the housing part 5 along the longitudinal axis L of the base 2, the housing part 5 is tightened to the base 2 by the respective configurations of the cooperating mounting elements 40 and mounting structures 25. Accordingly, the mounting elements 40 and mounting structures 25 can be preformed, avoiding the need for an operator to manually form or modify the mounting elements 40 for each individual connector. Further, the preformed mounting elements 40 and mounting structures 25 are accurately shaped to ensure adequate tightening of the housing part 5 to the base 2.

During the motion of the housing part 5 in the direction of the longitudinal axis L from the mounting position to the mounted position, significant forces may develop between the mounting structure 25 of the base 2 and the mounting elements 40 of the housing part S. The counterforce structures 41 can be applied to oppose the force indicated by the arrow F8 and prevent deformation or damage of the thinner portion 21 of the base 2.

Figure 7A:
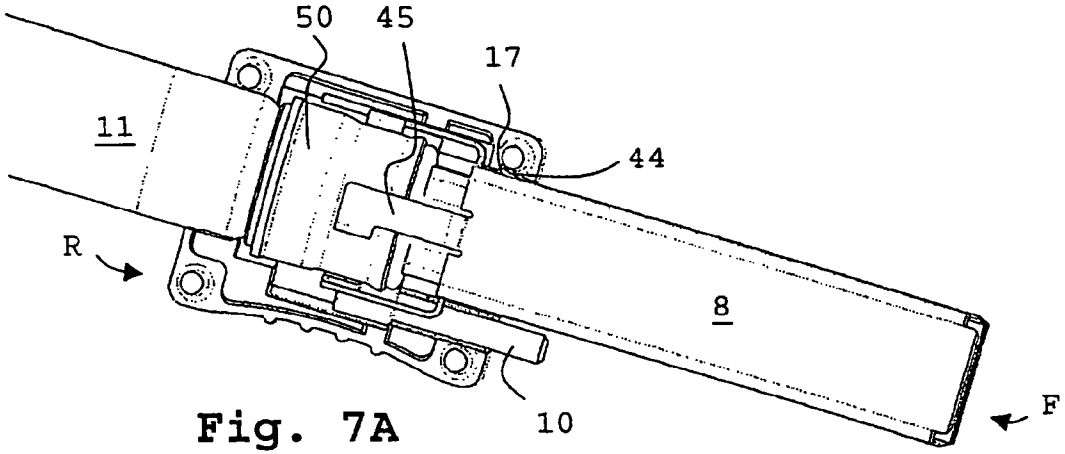
FIGS. 7A-7C show two embodiments of a locking arrangement for the housing part to the base of the cable connector.
Figure 7C:
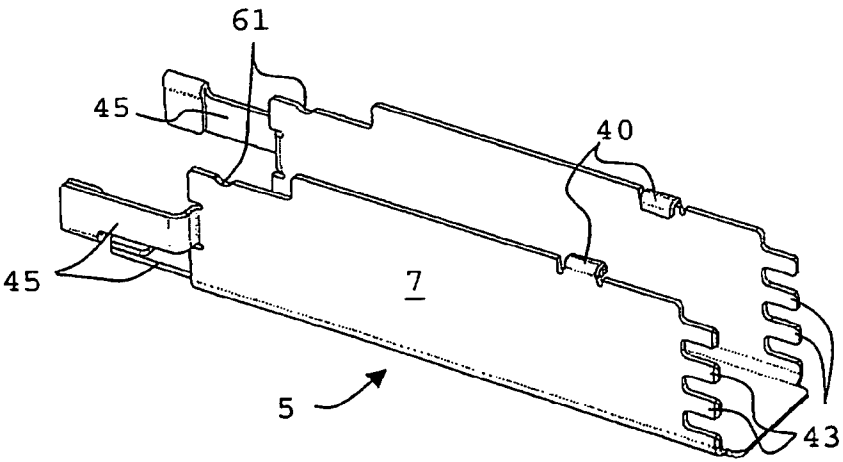
Figure 7B:
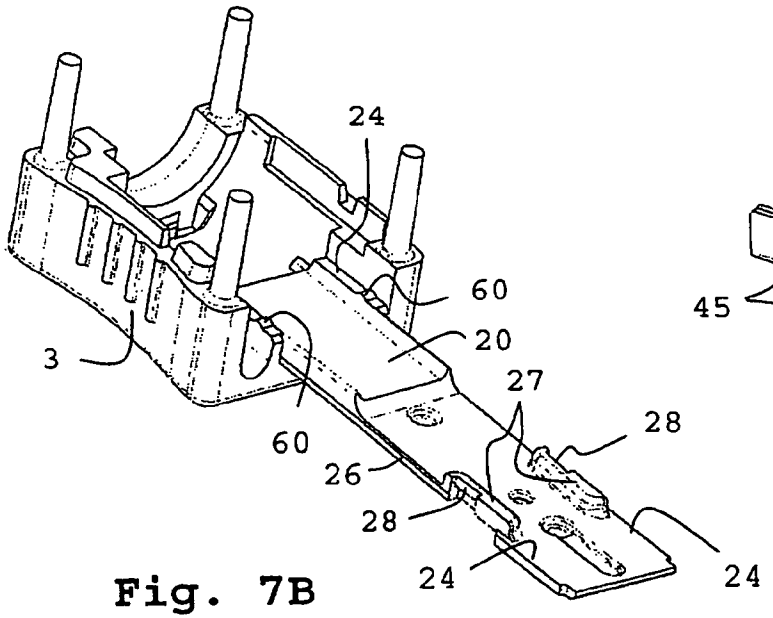

FIGS. 7A-7C show two embodiments of a locking arrangement for the housing part 5 to the base 2 of the cable connector 1. The interaction of the flexible mounting elements 40 with the sloped surfaces 31, 32 of the wedge-shaped structures 30 in the mounted position of the housing part 5 results in a spring force action back to the mounting position. Therefore, it is advantageous to lock the housing part 5 once the housing part is in the mounted position shown in FIGS. 6A-6C. The locking arrangement allows the operator to lock the housing part 5 in the mounted position and enables him to test or further complete the cable connector 1.

Figure 2:
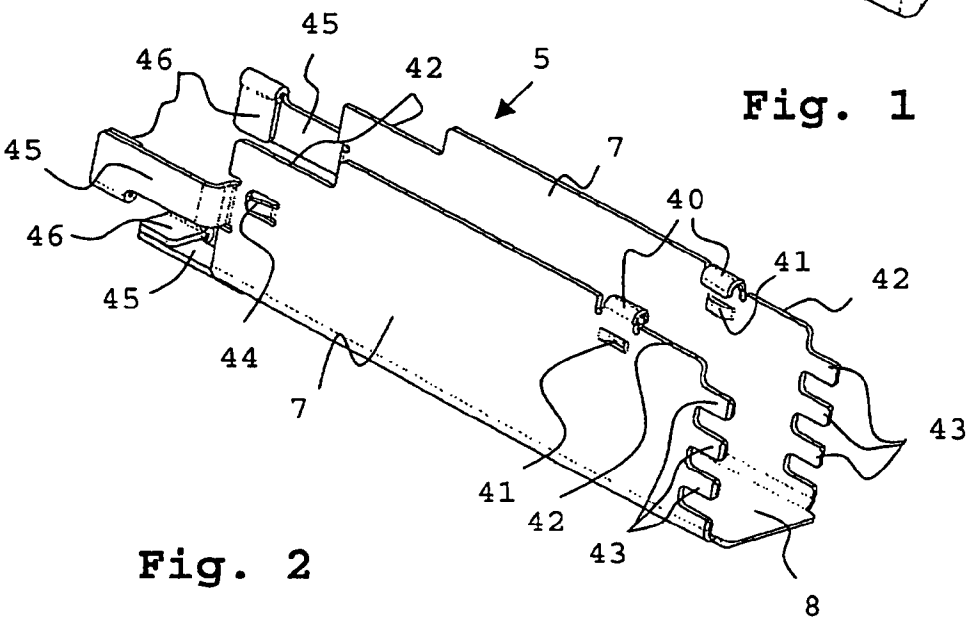
FIG. 2 shows a housing part of the cable connector of FIG. 1 according to an embodiment of the invention.
Figure 3B:
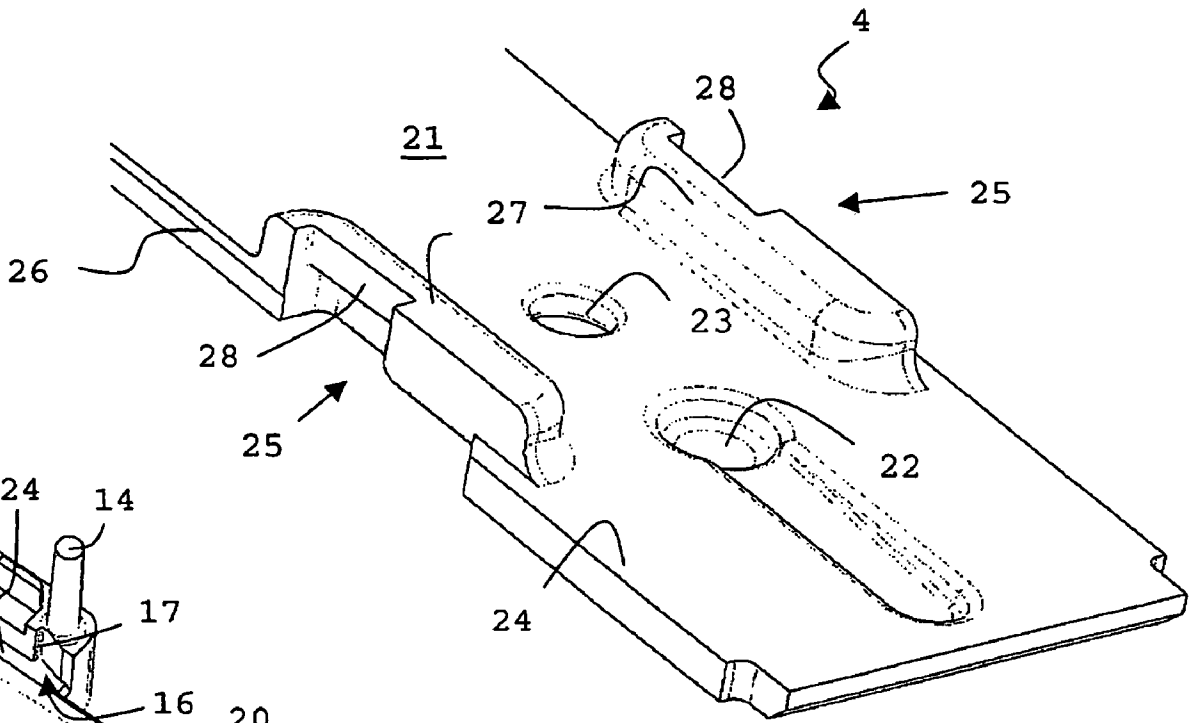
FIGS. 3A-3F show various images and details of a base of the cable connector of FIG. 1 according to an embodiment of the invention.
Figure 3A:
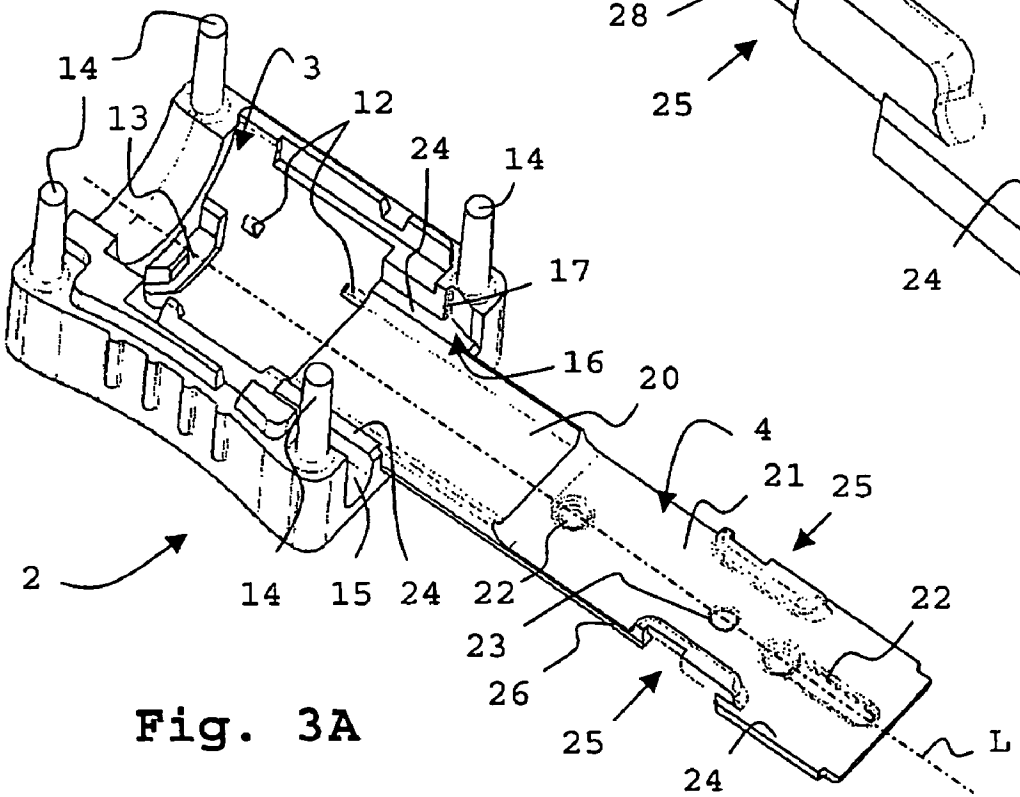
Figure 3D:
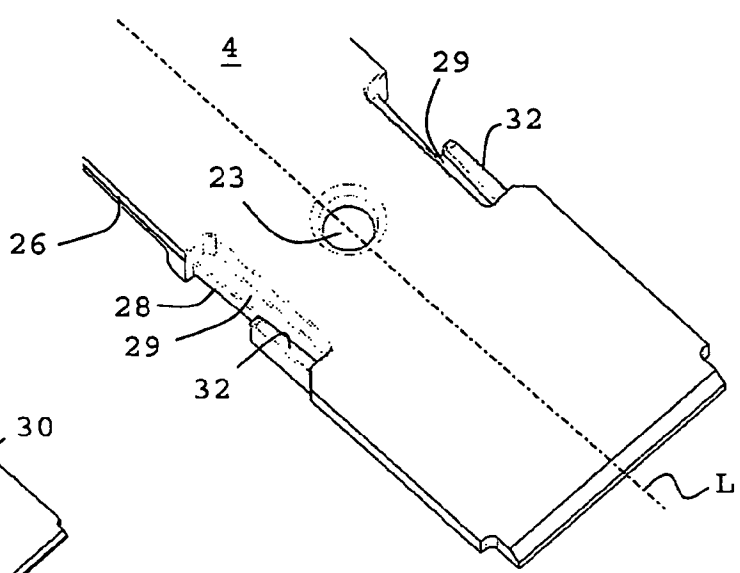
Figure 3C:
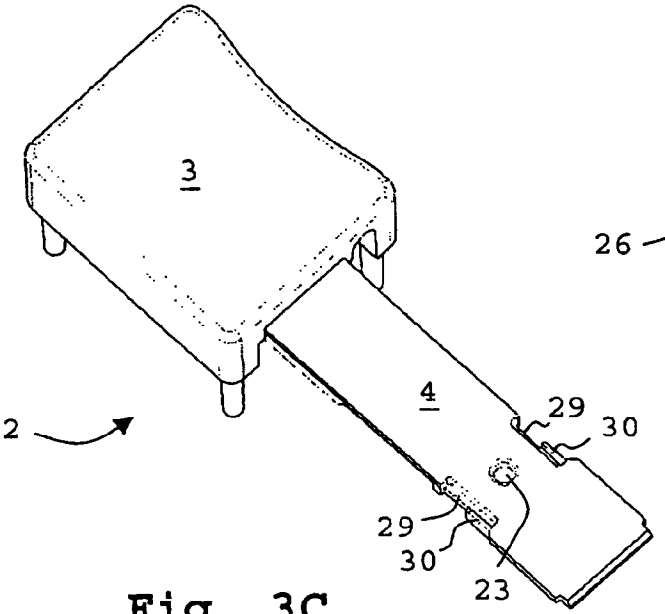
Figure 3F:
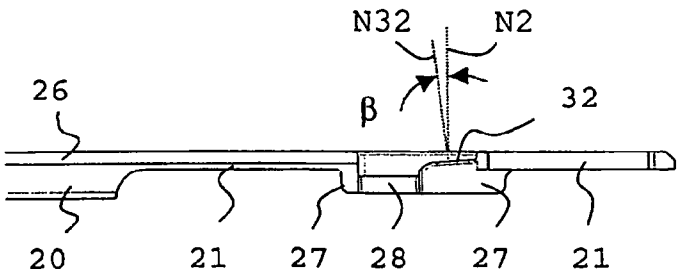
Figure 3E:
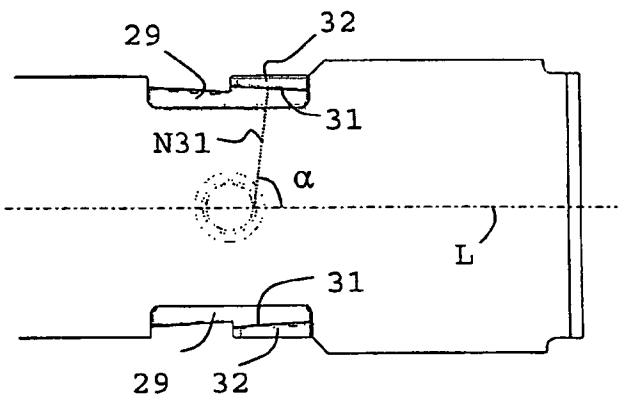

FIG. 7A depicts a first embodiment, wherein the housing part 5 of FIG. 2 is locked by a base 2 as depicted in FIG. 3A. The latch 44 cooperates with the surface 17 of the locking structure 17 to lock the housing part 5 in said mounted position. The latch 44 and locking structure 16 are positioned such that locking action takes place when in the mounted position. This latched arrangement guarantees safe locking of the housing part 5.

FIGS. 7B and 7C illustrate a further embodiment with a slightly modified base 2 and housing part 5. The base 2 comprises convex structures 60 at the support surfaces 24 while the housing part 5 comprises complementary concave elements 61 at the contact edges 42. When the housing part 5 is in the mounted position, the convex structures 60 and concave elements 61 coincide and lock the housing part 5 in the mounted position. Such a locking arrangement can be easily manufactured and does not require the operator to manipulate a latch when reopening the housing. Accordingly, reparability of the cable connector 1 is improved.

Figure 8B:
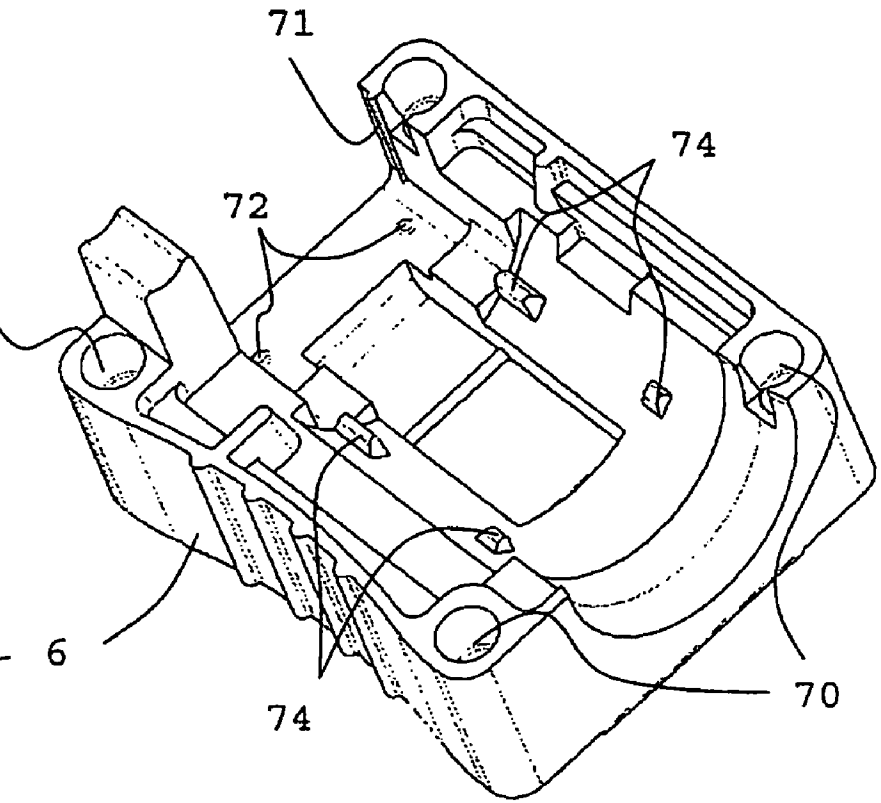
FIGS. 8A and 8B show a further housing part of the cable connector of FIG. 1 according to an embodiment of the invention.
Figure 8A:
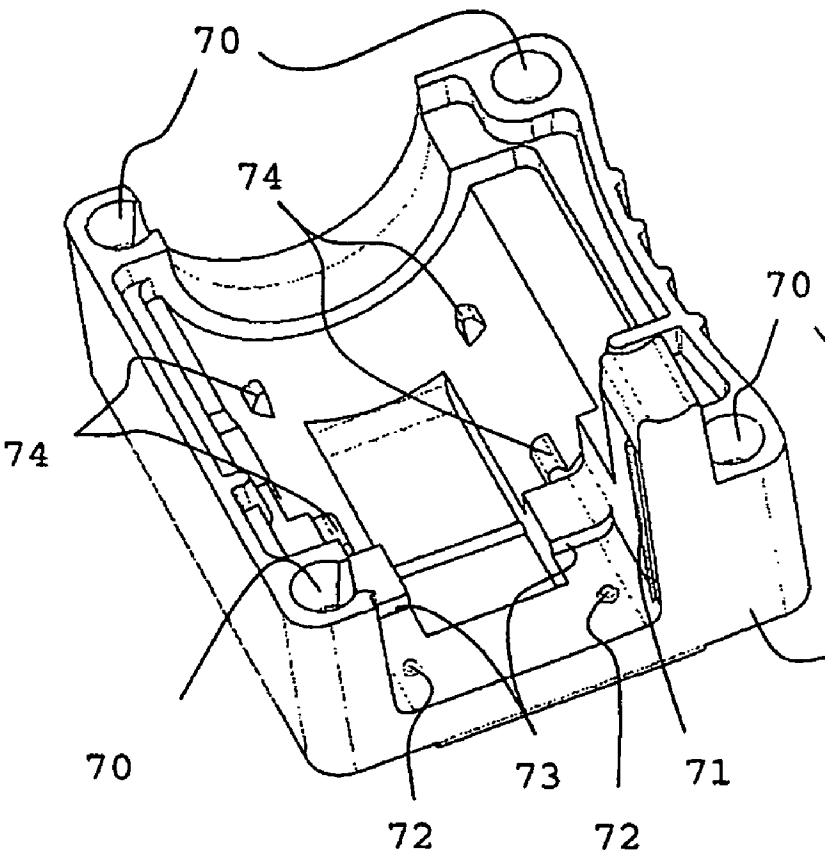

FIGS. 8A and 8B illustrate from different perspectives an embodiment of the further housing part 6 to complete the housing of the cable connector 1 at the ferrule portion 3 of the base 2. This further housing part 6 is typically mounted on the ferrule portion 3 by inserting the mounting pillars 14 in the openings 70 when the housing part 5 is in the mounted and locked position.

The further housing part 6 comprises several structures 71, 72, 73 to interact with the housing part 5. The ribs 71 force the sidewalls 7 of the housing part 5 towards the base 2, while the same effect is achieved for the top wall 8 by the protrusions 72, when the further housing part 6 is mounted to the ferrule portion 3 of the base 5. Moreover, the further housing part 6 has an internal surface 73 to block the housing part 5 from moving backwards to the mounting position. Such a blocking feature is especially relevant if the cable connector 1 has a locking arrangement as displayed in FIGS. 7B and 7C. Further, the further housing part 6 has internal structures 74 with comparable function as ribs 12 in the ferrule portion 3 of the base 2.

Finally, in FIGS. 9A and 9B the completed cable connector 1 is shown in side view and in cross-section A-A. In FIG. 9B, clearly the internal surface 73 blocks the housing part 5. The arrangement of the cable 11 in the ferrule system 50 and its accommodation in ferrule portion 3 of the cable connector 1 is described in the previously cited Dutch patent application NL 1026451.

It should be noted that the embodiment of the cable connector described above does not limit the scope of the invention; further modifications are possible such as providing a slope for the bottom of the guiding slot 29 to force the top wall 8 of the housing part 5 towards the base 2, either in combination or without the sloped surface 32 of the wedge-shaped structure 30.

The invention claimed is:

1. A cable connector with a housing comprising:

a base extending along a longitudinal axis between a front side and a rear side of said cable connector, said base comprising one or more mounting structures;

at least one housing part with one or more mounting elements said mounting elements adapted to cooperate with said mounting structures to mount said housing part to said base to complete said housing, wherein said housing part comprises a top wall and side walls, said side walls comprising said mounting elements, and wherein said mounting structures and said mounting elements are structured such that said side walls are forced towards said longitudinal axis and said top wall is forced towards said base when said housing part is moved from a mounting position to a mounted position.

2. The cable connector according to claim 1, wherein said base comprises edges parallel to said longitudinal axis and said mounting structures are provided at said edges, each of said mounting structures comprising a guiding slot for said mounting element and a wedge-shaped structure adapted to cooperate with said mounting element to force said housing part towards said base.

3. The cable connector according to claim 2, wherein said wedge-shaped structure comprises a first surface with a normal making a first angle with respect to said longitudinal axis to force said- housing part towards said base.

4. The cable connector according to claim 3, wherein said mounting element comprises a hook-shaped section with an inner surface arranged to abut said first surface of said wedge-shaped structure on mounting, wherein the normal of said inner surface makes a second angle with respect to said longitudinal axis and wherein said second angle is smaller than said first angle.

5. The cable connector according to claim 2, wherein the normal of a guiding surface of said guiding slot and/or the normal of a second surface of said wedge-shaped structure build an angle with a direction normal to said base such that a top wall of said housing part is forced towards said base when moving said housing part along said longitudinal axis from said mounting position to said mounted position.

6. The cable connector according to claim 1, wherein said mounting structure is provided at said base in a bulge protruding inside said housing.

7. The cable connector according to claim l, wherein said mounting structures comprise an insertion structure adapted to insert said mounting elements substantially perpendicularly to said longitudinal axis in said mounting position.

8. The cable connector according to claim 1, wherein said housing part comprises counter-force structures near said mounting elements adapted to interact with said base opposite to said force towards said base when said housing part is moved from said mounting to said mounted position

9. The cable connector according to claim 1, wherein said mounting elements comprise pre-formed hook-shaped elements and wherein at least a part of the inner surface of said hook-shaped elements is arranged to abut said mounting structure in said mounted position.

10. The cable connector according to claim 1, wherein said base comprises one or more support structures adapted to support contact edges of said housing part, such that said contact edges of said housing part are in planar contact with said base when said housing part is moved from said mounting to said mounted position.

11. The cable connector according to claim 1 wherein said cable entry portion comprises a locking structure adapted to cooperate with Locking elements of said housing part when said housing part is in said mounted position

12. The cable connector according to claim 11, wherein said locking element comprises a latch and said locking structure comprises a surface adapted to cooperate with said latch to lock said housing part in said mounted position.

13. The cable connector according to claim 11, wherein said locking element comprises a convex or a concave element and said locking structure comprises a complementary concave respectively convex structure to lock said housing part in said mounted position.

14. The cable connector according to claim 1, wherein said further portion comprises one or more terminal block housings, each having at least one positioning profile and said housing part comprises a front edge with one or more positioning elements adapted to cooperate with said positioning profile such that the position of said terminal block housings in the direction normal to said base is determined by said housing part in said mounted position.

15. The cable connector according to claim 1, wherein said housing part comprises one or more mounting beams extending from a rear edge of said housing part towards said cable entry portion.

16. The cable connector according to claim 1, wherein said cable connector comprises a further housing part adapted to cooperate with said base to complete said housing at said cable entry portion and wherein said further housing part comprises structures to interact with said housing part to force said housing part towards said base and/or to block said housing part from moving towards said mounting position.

17. The cable connector according to claim 1, wherein said base is a diecast metal base and said housing part is a sheet metal housing part.

18. A cable connector with a housing comprising:

a base extending along a longitudinal axis between a front side and a rear side of said cable connector, said base comprising a cable entry portion for a cable at said rear side and a further portion extending from said cable entry portion along said longitudinal axis to said front side, wherein said further portion comprises one or more mounting structures;

at least one housing part with one or more mounting elements said mounting elements adapted to cooperate with said mounting structures to mount said housing part to said base to complete said housing at said further portion;

wherein said mounting structures and said mounting elements are structured such that said housing part is forced towards said base when said housing part is moved along said longitudinal axis from a mounting position to a mounted position, wherein said mounting element comprises a hook- shaped section with an inner surface arranged to abut a wedge-shaped structure on the base, wherein a normal of said inner surface is angled with respect to said longitudinal axis when the housing part is in the mounted position.

19. A cable connector housing comprising:

a base extending along a longitudinal axis between a front side and a rear side of the cable connector, the base comprising at least one mounting structure;

a housing part with at least one mounting element, wherein the mounting element is adapted to cooperate with the mounting structure to mount the housing part to the base, wherein the housing part comprises a top wall and side walls, wherein at least one of the side walls comprising the mounting element, and wherein the mounting structure and the mounting element are sized and shaped such that the at least one side wall is forced towards the longitudinal axis when the housing part is longitudinally moyad generally parallel to the longitudinal axis on the base from a mounting position to a mounted position.

* * * * *

UNITED STATES PATENT AND TRADEMARK OFFICE

CERTIFICATE OF CORRECTION

PATENT NO. : 7,544,095 B2
APPLICATION NO. : 11/660010
DATED : June 9, 2009
INVENTOR(S) : Droesbeke et al.

It is certified that error appears in the above-identified patent and that said Letters Patent is hereby corrected as shown below:

IN THE CLAIMS:

Claim 19, column 10, line 64, delete “moyad” and replace with --moved--.

Signed and Sealed this

Twenty-eighth Day of July, 2009

JOHN DOLL
*Acting Director of the United States Patent and Trademark Office*